US009666419B2

(12) United States Patent
Jiang et al.

(10) Patent No.: US 9,666,419 B2
(45) Date of Patent: May 30, 2017

(54) IMAGE INTENSIFIER TUBE DESIGN FOR ABERRATION CORRECTION AND ION DAMAGE REDUCTION

(71) Applicant: KLA-Tencor Corporation, Milpitas, CA (US)

(72) Inventors: Ximan Jiang, San Mateo, CA (US); Qing Li, San Jose, CA (US); Stephen Biellak, Sunnyvale, CA (US)

(73) Assignee: KLA-Tencor Corporation, Milpitas, CA (US)

( * ) Notice: Subject to any disclaimer, the term of this patent is extended or adjusted under 35 U.S.C. 154(b) by 708 days.

(21) Appl. No.: 13/957,890

(22) Filed: Aug. 2, 2013

(65) Prior Publication Data

US 2014/0063502 A1 Mar. 6, 2014

Related U.S. Application Data

(60) Provisional application No. 61/694,055, filed on Aug. 28, 2012.

(51) Int. Cl.
*H01J 40/16* (2006.01)
*H01J 31/50* (2006.01)

(52) U.S. Cl.
CPC ..... *H01J 40/16* (2013.01); *H01J 31/50* (2013.01)

(58) Field of Classification Search
CPC ..... H01J 31/50; H01J 40/16
USPC ..... 356/432–444
See application file for complete search history.

(56) References Cited

U.S. PATENT DOCUMENTS 2,731,560 A * 1/1956 Krawinkel ..... H01J 29/74 313/399
3,012,170 A * 12/1961 Heil ..... H01J 25/12 315/5.38
3,043,974 A * 7/1962 McGee ..... H01J 31/503 313/152

(Continued)

FOREIGN PATENT DOCUMENTS

EP 0743670 A1 11/1996
WO 02-082494 A1 10/2002

OTHER PUBLICATIONS

G. Papp, "Limits of Resolution in Magnetically Focused Image Converter Tubes," Nuclear Science, IRE Transactions, vol. 9, Issue 2, pp. 91-93 (1962).

(Continued)

*Primary Examiner* — Tri Ton
*Assistant Examiner* — Jarreas C Underwood
(74) *Attorney, Agent, or Firm* — Suiter Swantz pc llo

(57) ABSTRACT

The disclosure is directed to image intensifier tube designs for field curvature aberration correction and ion damage reduction. In some embodiments, electrodes defining an acceleration path from a photocathode to a scintillating screen are configured to provide higher acceleration for off-axis electrons along at least a portion of the acceleration path. Off-axis electrons and on-axis electrons are accordingly focused on the scintillating screen with substantial uniformity to prevent or reduce field curvature aberration. In some embodiments, the electrodes are configured to generate a repulsive electric field near the scintillating screen to prevent secondary electrons emitted or deflected by the scintillating screen from flowing towards the photocathode and forming damaging ions.

40 Claims, 10 Drawing Sheets

(56) References Cited

U.S. PATENT DOCUMENTS 3,238,465 A * 3/1966 Wuerker ..... H01J 25/49 315/15
3,274,416 A * 9/1966 Rotow ..... H01J 31/36 250/214 VT
3,417,242 A * 12/1968 Windebank ..... H01J 31/501 250/214 VT
3,439,222 A * 4/1969 Driard ..... H01J 29/624 313/529
3,462,601 A * 8/1969 Sternglass ..... G01T 1/1645 250/214 VT
3,478,216 A * 11/1969 Carruthers ..... H01J 31/503 250/214 VT
3,697,795 A * 10/1972 Braun ..... H01J 31/501 250/214 VT
3,806,756 A * 4/1974 Low ..... H01J 31/26 313/529
3,829,688 A * 8/1974 Barrett ..... G01T 1/1642 250/237 G
4,070,574 A 1/1978 Fletcher et al.
4,115,722 A * 9/1978 Johnson ..... H01J 29/00 250/214 VT
4,208,577 A * 6/1980 Wang ..... H01J 31/505 250/214 VT
4,345,153 A * 8/1982 Yin ..... G01T 1/36 250/369
4,350,919 A * 9/1982 Johnson ..... H01J 31/502 250/214 VT
4,370,586 A 1/1983 Fitts
4,791,300 A * 12/1988 Yin ..... G01T 1/28 250/363.01
5,177,350 A * 1/1993 Beauvais ..... H01J 31/501 250/214 VT
5,395,738 A * 3/1995 Brandes ..... B82Y 10/00 250/492.24
5,475,227 A * 12/1995 LaRue ..... G01N 23/2273 250/207
5,959,302 A 9/1999 Charpak
6,787,772 B2 * 9/2004 Ose ..... H01J 37/147 850/9
6,934,360 B2 * 8/2005 De Groot ..... G21K 1/043 250/208.1
2007/0051879 A1 * 3/2007 Kuzniz ..... H01J 31/501 250/214 VT
2009/0032722 A1 2/2009 Ito et al.
2012/0199752 A1 8/2012 Desaute

OTHER PUBLICATIONS

R. Waynant et al., "Electro-Optics Handbook," McGraw-Hill, New York, pp. 578-634 (1994).
G. Carruthers, "Magnetically Focused Electronographic Image Converters for Space Astronomy Applications," Applied Optics, vol. 8, No. 3, p. 633 (1969).
J. Grames et al., www.jlab.org/accel/inj_group/docs/2007/Grames_PST07_final.pdf, Printed Online (Mar. 10, 2015).

* cited by examiner

100

100

100

IMAGE INTENSIFIER TUBE DESIGN FOR ABERRATION CORRECTION AND ION DAMAGE REDUCTION

PRIORITY

The present application claims priority to U.S. Provisional Application Ser. No. 61/694,055, entitled ABBERATION CORRECTED MAGNETIC FOCUS INTENSIFIER TUBE DESIGN, By Ximan Jiang, filed Aug. 28, 2012, or is an application of which currently co-pending application(s) are entitled to the benefit of the filing date. The foregoing provisional application is hereby incorporated by reference in its entirety.

TECHNICAL FIELD

The present disclosure generally relates to the field of optical devices and more particularly to magnetic focus image intensifiers.

BACKGROUND

Image intensifier tubes are widely used to magnify low light signals. Image intensifiers based on micro-channel plate (MCP) and proximity focus concept can provide high gain due to MCP magnification, low distortion, and uniform resolution across an entire field of view. However, MCP based image intensifiers tend to have relatively bad resolution for many critical applications. In addition, MCP may block as much as 40% of the photoelectrons right after the photocathode. Thus, detective quantum efficiency for MCP based image intensifiers is usually low.

To achieve higher detective quantum efficiency, intensifier designs based on electrostatic focusing lens and combined magnetic-electrostatic focusing tube may be utilized. Pure electrostatic image intensifiers usually have high distortion and field-curve aberration. Some electrostatic image intensifiers have either curved photocathode plane or curved scintillating screen (e.g. phosphor screen) plane. However, upstream illumination optics and downstream collection light optics usually have flat image and object field. As a result, electrostatic image intensifiers are not suitable for applications requiring both high spatial resolution and low distortion.

Conventional magnetically focused image intensifier tube design has been discussed in detail in publications, such as *Electro-Optics Handbook*, R. Waynant and M. Ediger, McGraw-Hill (1994). Electron optics has been discussed in detail in *IRE transactions on Nuclear Science*, volume 9, issue 2, pages 91-93. Conventional electron optics for magnetically focused intensifier is based on the concept of uniform electric accelerating field $\vec{E}$ and homogeneous magnetic focusing field $\vec{B}$ along the tube axis. When photoelectrons are emitted from a photocathode in response to incident illumination, their initial velocity has a transverse component. Transverse velocity is perpendicular to the magnetic field lines. As a result, photoelectrons with non-zero transverse velocity will rotate along the magnetic field lines while being accelerated from the photocathode towards a scintillating screen disposed at an opposite end of the tube. The focusing condition is that photoelectrons make a full integer number of turns. Depending on $\vec{B}$ field strength, more than one focus node may exist inside the tube. The time for photoelectrons to make one full turn in magnetic field $\vec{B}$ may be determined by the following equation:

$$T = \frac{2\pi \cdot m_e}{e \cdot B},$$

where e is electron charge, $m_e$ is electron mass and B is the magnetic field strength.

The focusing condition is satisfied once electrons travel from the photocathode to the scintillating screen in time interval nT, where n is an integer. Electron travel time is determined by electric accelerating field strength $\vec{E}$. The focusing power is substantially the same everywhere when there are uniform $\vec{E}$ and $\vec{B}$ fields. To create uniform $\vec{B}$ field, a magnetic solenoid disposed outside to the intensifier tube may need to be at least three times the length of the tube. This is in order to generate relatively uniform magnetic field across the distance occupied by the intensifier tube. Due to design constraints, shorter magnetic solenoids are typically preferred. However, magnetic field is typically not uniform with a shorter magnetic solenoid. Degradation of resolution due to non-uniform magnetic field is mentioned in *IRE Transaction on Nuclear Science*, volume 9, issue 4, pages 55-60.

The $\vec{B}$ field lines generated by a short magnetic solenoid are usually divergent around the photocathode and the scintillating screen. Off-axis photoelectrons may be bent towards the tube center right after photocathode and then bent outwards. As a result, the distance traveled by off-axis photoelectrons may be longer than that of on-axis photoelectrons. The off-axis photoelectrons will, therefore, be focused before they arrive at the scintillating screen. This kind of focusing error is known as field curvature aberration. If soft ion pole pieces are used to shield outer electromagnetic interference, the magnetic field strength may become stronger at off-axis locations compared with the magnetic field strength at the center of the tube. Stronger $\vec{B}$ field at off axis points can further increase the field curvature aberration. High field curvature aberration results in non-uniform resolution from the center to the edge of the field of view.

Lifetime of magnetic focus image intensifiers is also currently limited by damage from ions accelerated toward the photocathode, as discussed in U.S. Pub. No. 2007/0051879 A1. Photoelectrons will deposit accumulated energy into the scintillating screen and excite cathodoluminescence emission. In the meantime, secondary and backscattering electrons may be knocked out of the scintillating screen surface. The low energy secondary and backscattering electrons have high electron-impact ionization cross section and may create positive ions around the scintillating screen area. The positively charged ions are then accelerated backwards through the tube towards the photocathode. Back-bombardment from ions can cause serious damage to the photocathode and reduce quantum efficiency.

The foregoing deficiencies hinder utilization of magnetic focus image intensifiers in many applications. New designs to overcome one or more of the foregoing deficiencies will be appreciated by those skilled in the art.

SUMMARY

Various embodiments of the disclosure include an image intensifier tube including at least a photocathode, a plurality of electrodes, and a scintillating screen. The photocathode is configured to emit electrons in response to incident illumination. The electrons emitted from the photocathode are accelerated along an acceleration path defined by the electrodes to the scintillating screen. The scintillating screen is configured to emit illumination in response to incident electrons including at least a portion of the emitted electrons received from the photocathode via the acceleration path.

In some embodiments, the electrodes are configured to generate at least a first accelerating electric field along a first portion of the acceleration path being traversed by at least one off-axis portion of the emitted electrons. The electrodes may be further configured to generate a second accelerating electric field along a second portion of the acceleration path being traversed by at least one on-axis portion of the emitted electrons, where the first accelerating electric field is stronger than the second accelerating electric field. Accordingly, the off-axis electrons are accelerated faster than the on-axis electrons along at least a portion of the acceleration path. Since the off-axis electrons typically must travel a longer distance to the scintillating screen to achieve substantially uniform electron focus, the added acceleration along a portion of the acceleration path promotes substantially uniform arrival (i.e. focus) of the off-axis and on-axis electrons at the scintillating screen.

In some embodiments, the electrodes are configured to generate a repulsive electric field relative to the scintillating screen preventing at least a portion of secondary electrons emitted or deflected by the scintillating screen from travelling towards the photocathode. Accordingly, the secondary electrons are prevented from forming ions in the direction of the photocathode to avoid damage of the photocathode from back-bombardment of ions. The repulsive electric field generated by the electrodes may further defocus ions accelerated towards the photocathode, thereby decreasing the damaging effect of any ions formed around the scintillating screen.

The foregoing embodiments and those further discussed herein may be combined to achieve multiple advantages. For example, the electrodes may be configured to promote substantially uniform focus of off-axis and on-axis electrons on the scintillating screen and further configured to repel back-flowing secondary electrons emitted or deflected from the scintillating screen. Accordingly, the image intensifier tube may provide improved resolution uniformity across a substantial entirety of the resulting field of view and improved resistance to damage from ion back-bombardment.

Various embodiments of the disclosure further include a system for analyzing at least one sample incorporating the image intensifier tube. The system may include at least one illumination source configured to illuminate the sample. The image intensifier tube may be disposed within a collection path of the system and configured to receive illumination reflected, scattered, or radiated from the sample. The system may further include at least one detector configured to receive at least a portion of illumination emitted from the scintillating screen of the image intensifier tube as a result of the illumination collected from the sample. At least one computing system may be configured to receive information (e.g. image frame or intensity reading) associated with the detected illumination from the detector. The computing system may be further configured to determine at least one spatial or physical attribute of the sample based upon the detected illumination. For example, the computing system may be configured to perform a metrology or inspection algorithm to determine a spatial measurement (e.g. layer thickness, wall depth, feature spacing) or locate/identify a defect utilizing the information received from the detector.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Reference will now be made in detail to the subject matter disclosed, which is illustrated in the accompanying drawings.

FIGS. 1 through 3C illustrate various embodiments of an image intensifier tube, such as a magnetic focus image intensifier tube. Some embodiments of the image intensifier tube are directed to reducing or preventing field curvature aberration. Non-uniform focus of electrons due to field curvature aberration can be seen in the electron optics simulation illustrated in FIG. 1. Field curvature aberration in conventional image intensifier design is further discussed in *Electro-Optics Handbook*, R. Waynant and M. Ediger, McGraw-Hill (1994), which is hereby incorporated by reference. Uniformity of image resolution may be improved across a field of view imaged via embodiments of the image intensifier tube design discussed herein. Some embodiments of the image intensifier tube are alternatively or additionally directed to reducing or preventing photocathode damage from ion back-bombardment. Various image intensifier tube designs and applications are described in further detail below.

Figure 2A:
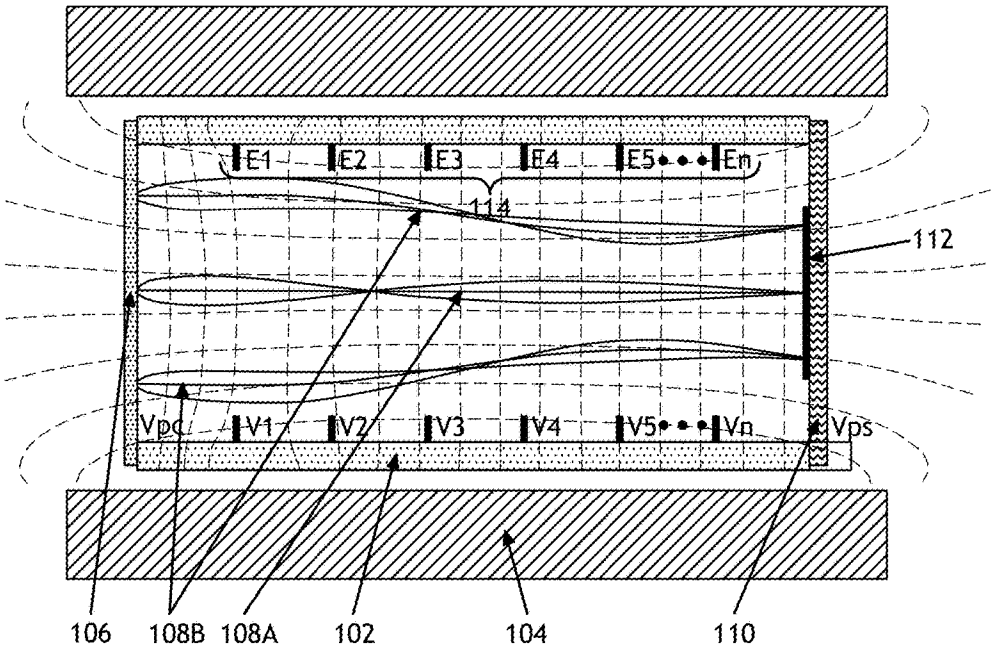
FIG. 2A illustrates an image intensifier tube configured for field curvature aberration correction, in accordance with an embodiment of this disclosure.
Figure 2B:
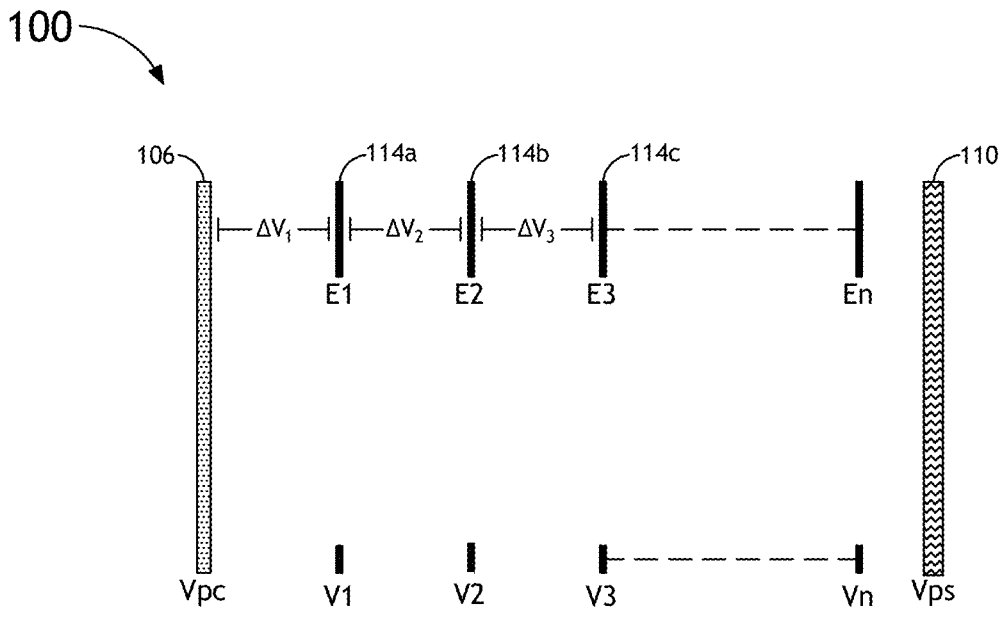
FIG. 2B illustrates electric potential differences between a photocathode and one or more electrodes of the image intensifier tube, in accordance with an embodiment of this disclosure.
Figure 2C:
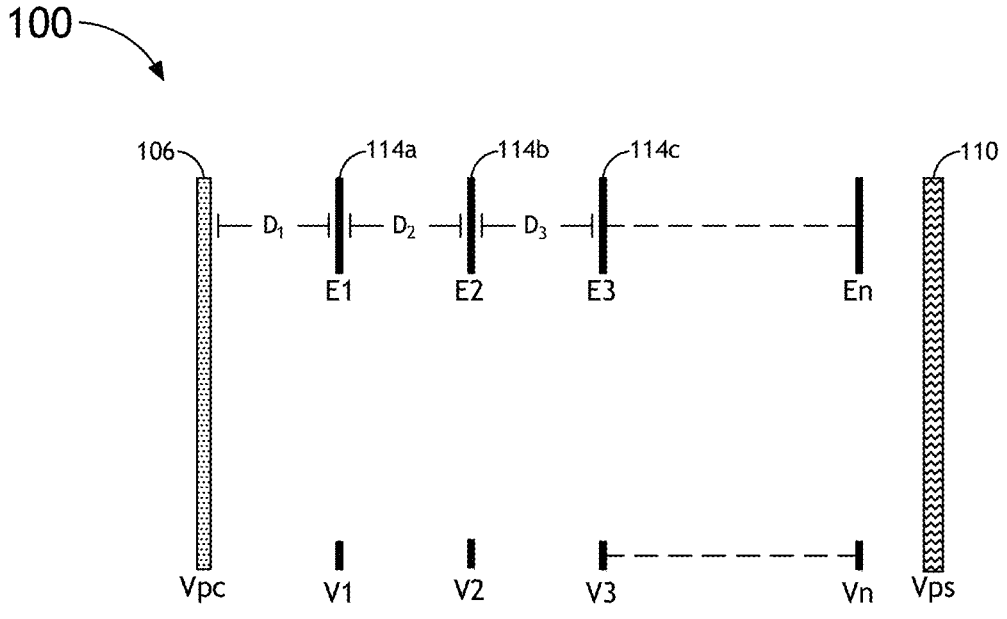
FIG. 2C illustrates spatial differences between the photocathode and one or more electrodes of the image intensifier tube, in accordance with an embodiment of this disclosure.

FIGS. 2A through 2C illustrate embodiments of an image intensifier tube 100 designed to correct field curvature aberration. Electrons travelling along an acceleration path of the image intensifier tube 100 make a full circle rotation in approximately $$T = \frac{2\pi \cdot m_e}{e \cdot B}.$$

Figure 1:
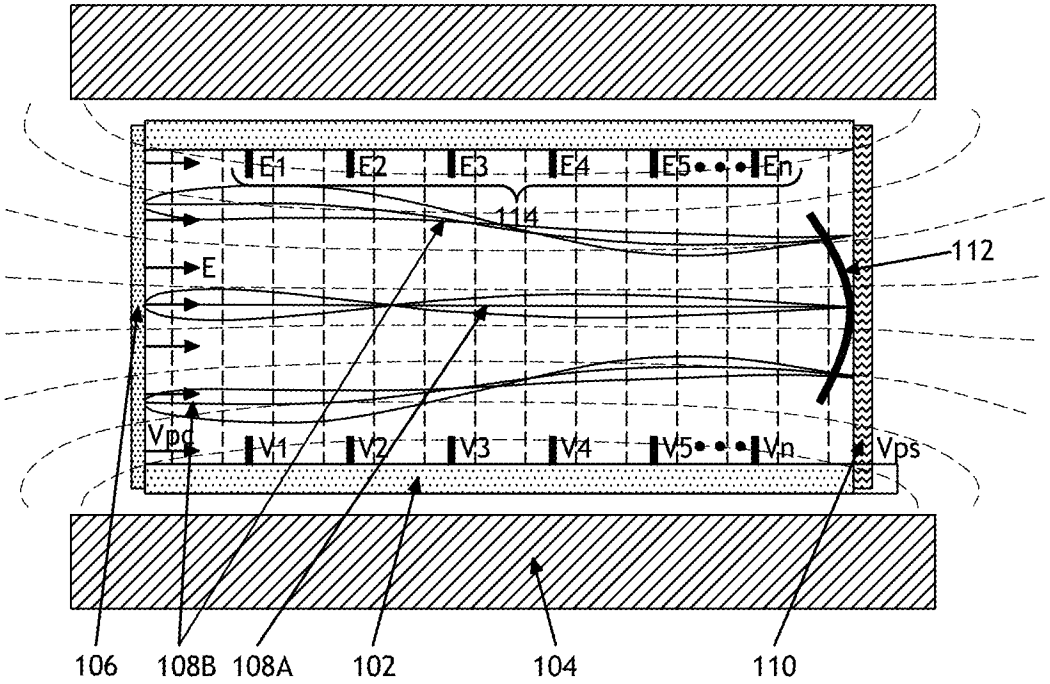
FIG. 1 illustrates an image intensifier tube.

As a result of diverging magnetic fields near ends of the image intensifier tube 100, off-axis electrons may be forced along a less direct path than on-axis electrons. To achieve substantially uniform electron focus, therefore, the off-axis electrons need to travel a greater distance than on-axis photoelectrons during the period nT that electrons make an integer n number of turns. Field curvature aberration can otherwise occur due to a disparity between off-axis electron focus and on-axis electron focus within the tube. As illustrated in FIG. 1, for example, a curved focus plane 112 rather than a flat focus plane results when the off-axis electrons 108B reach focus at a point along the acceleration path before the on-axis electrons 108A.

In some embodiments, the image intensifier tube 100 is configured to accelerate off-axis electrons faster than on-axis electrons along at least a portion of the acceleration path. Accordingly, the off-axis electrons travel a longer distance than the on-axis electrons to reduce or prevent field curvature aberration. The additional distance travelled by the off-axis electrons may be controlled to achieve substantially uniform electron focus (i.e. a substantially flat focus plane) for substantially uniform image resolution across the entire field of view.

FIG. 2A illustrates an embodiment of the image intensifier tube 100 including a vacuum tube 102 at least partially surrounded by a magnetic solenoid 104. A photocathode 106 disposed at a first end of the vacuum tube 102 is configured to emit electrons 108 in response to incident illumination. The image intensifier tube 100 further includes a plurality of electrodes 114, each having a respective electric potential. For example, voltages V1, V2, . . . , Vn may be respectively applied to electrodes E1, E2, . . . , En. The electrodes 114 are configured to accelerate electrons 108 emitted by the photocathode 106 along an acceleration path to a scintillating screen 110 disposed at a second end of the vacuum tube 102. In some embodiments, the scintillating screen 110 includes a phosphor screen comprised of small particles or a fully crystalline material. The scintillating screen 110 is configured to emit illumination (i.e. cathodoluminescence) in response to excitation by the accelerated electrons 108. As a result of increased energy from electron acceleration through the vacuum tube 102, the output illumination emitted by the scintillating screen 110 is more intense than the input illumination received at the photocathode 106.

The electrodes 114 may be configured to accelerate electrons 108B at off-axis points towards the edges of the vacuum tube 102 faster along at least a portion of the acceleration path than on-axis electrons 108A travelling around the center of the vacuum tube 102, thereby compensating for the additional distance that must be travelled by the off-axis electrons 108B for substantially uniform electron focus at the scintillating screen 110. For example, the electrodes 114 may be configured to generate a first accelerating electric field along a first portion of the vacuum tube 102 being traversed by a portion of off-axis electrons 108B emitted from the photocathode 106 and further configured to generate a second accelerating electric field around a second portion of the vacuum tube 102 being traversed by a portion of on-axis electrons, where the first accelerating electric field is stronger than the second accelerating electric field.

The electrodes 114 may be further configured to generate accelerating electric fields with different strength levels around one or more regions proximate to the photocathode 106 to achieve substantially uniform arrival of the on-axis and off-axis electrons 108 at the scintillating screen 110. Accordingly, the electrons 108 may reach a substantially flat or uniform focus plane 112 at the scintillating screen. Since electron velocity and energy is low around photocathode area, it may be more effective to generate an acceleration profile around the photocathode 106, as shown in FIG. 2A, to correct field curvature aberration. Once off-axis aberration is corrected, high resolution with substantial uniformity may be obtained across the entire field of view imaged by the image intensifier tube 100.

FIGS. 1B and 1C illustrate various embodiments of the image intensifier tube 100 where accelerating electric fields are controlled along the acceleration path according to a configuration of electric potential differences ΔV and/or spatial differences D between the photocathode 106 and one or more of the electrodes 114. By manipulating the electric potential differences ΔV and/or spatial differences D a negative electrostatic lens may be effectively formed around the photocathode 106 (as illustrated by equipotential lines in FIG. 2A) to correct positive field curvature aberration caused by the magnetic solenoid 104.

As shown in FIG. 2B, the electrodes 114 are each configured to carry a respective electric potential V1, V2, . . . , Vn. The accelerating electric fields along different portions of the acceleration path may be controlled by applying different electric potentials to one or more of the electrodes 114 to vary the potential differences ΔV, according to a specified acceleration profile. For example, the electrodes 114 may be configured to establish a first potential difference ΔV1 between the photocathode 106 and a first electrode 114A greater than a second potential difference ΔV2 between the first electrode 114A and a second electrode 114B, where ΔV1=V1−Vpc and ΔV2=V2−V1. Electric potential differences between additional electrodes may be adjusted as well to achieve the specified acceleration profile needed for aberration correction. For example, the second potential difference ΔV2 may be greater than a third potential difference ΔV3 between the second electrode 114B and a third electrode 114C, and so on.

In some embodiments, varying the electric potential applied to each electrode 114 enables uniform spatial distribution of the electrodes 114 within the vacuum tube 102. However, accelerating electric fields along different portions of the acceleration path may also be controlled according to spatial differences D between the photocathode 106 and one or more of the electrodes 114. As shown in FIG. 2C, the electrodes 114 may be distributed along the vacuum tube 102 according to a specified acceleration profile. To generate stronger accelerating electric fields at off-axis locations around the photocathode, a first spatial difference D1 between the photocathode 106 and the first electrode 114A may be lesser than a second spatial difference D2 between the first electrode 114A and the second electrode 114B. As with manipulation of the electric potential differences ΔV, the spatial differences D between several electrodes 114 may be varied to achieve the specified acceleration profile. For example, the second spatial difference D2 may be lesser than a third spatial difference D3 between the second electrode 114B and the third electrode 114C, and so on.

In some embodiments, spacing and electric potential differences between the photocathode 106 and one or more of the electrodes 114 are both established according to a specified acceleration profile. Controlling both parameters may enable finer tuning of the acceleration profile for improved aberration correction and higher resolution uniformity. It is further contemplated that additional configurations or devices may be employed to introduce stronger accelerating electric fields at off-axis portions of the acceleration path. Those skilled in the art will appreciate that functionally equivalent technology may be further included in the image intensifier tube 100 without departing from the scope of this disclosure.

FIGS. 2A through 2C illustrate embodiments of the image intensifier tube 100 designed to reduce damage to the photocathode 106 from ion back-bombardment. Some image intensifiers include a positive potential barrier to prevent ions 120 generated around the scintillating screen 110 from flowing backwards through the vacuum tube 102 towards the photocathode 106, as discussed in U.S. Pub. No. 2007/0051879 A1 which is incorporated herein by reference. For example, an electric potential Vps applied to the scintillating screen 110 may be lesser than an electric potential Vn applied to an electrode En proximate to the scintillating screen 110. The positive potential barrier generated as a result may prevent ions 120 generated around the scintillating screen 110 from reaching to the photocathode 106. However, ions 120 may continue to form past the positive potential barrier due to secondary electrons 118 emitted or deflected by the scintillating screen 110. Due to their negative charge, the secondary electrons 118 may be accelerated in the direction of the photocathode 106 towards the peak of the potential barrier deep into the vacuum tube 102. As a result, ions 120 may be generated around the peak of the potential barrier and can still be accelerated towards the photocathode 106 to cause ion damage. The ions 120 may also be focused on one portion of the photocathode 106 due to the positive potential barrier.

Figure 3A:
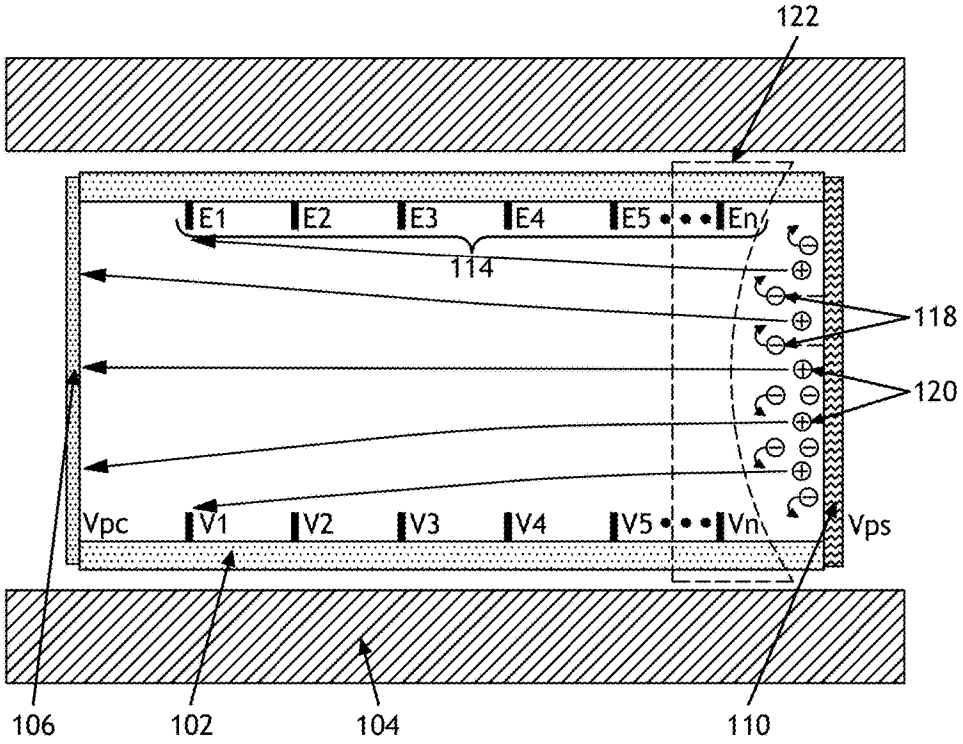
FIG. 3A illustrates an image intensifier tube configured for ion damage reduction, in accordance with an embodiment of this disclosure.

FIG. 3A illustrates an embodiment of the image intensifier tube 100 where the electrodes 114 are configured to establish a negative potential barrier to form a repulsive electric field 122 around the scintillating screen 110. The repulsive electric field 122 may prevent secondary electrons 118 emitted or deflected by the scintillating screen 110 from travelling backwards through the vacuum tube 102 towards the photocathode 106. Accordingly, secondary electrons 118 may be prevented from forming ions 120 deep within the vacuum tube 102. As a result, the number of ions 120 flowing towards the photocathode 106 may be significantly reduced. The repulsive electric field 122 may further have a diverging effect on back-flowing secondary electrons 118, thereby defocusing ions 120 generated from the back-flowing secondary electrons 118. Defocused ions 120 which are accelerated towards the photocathode 106 are not as damaging due to their dispersion across several portions of the photocathode 106 rather than densely accumulating at one location, such as the active region of the photocathode 106.

FIGS. 2B and 2C illustrate various embodiments of the image intensifier tube 100 where a repulsive electric field 122 is established and controlled according to a configuration of electric potential differences ΔV and/or spatial differences D between the scintillating screen 110 and one or more of the electrodes 114. By manipulating the electric potential differences ΔV and/or spatial differences D, a negative potential barrier is formed around the scintillating screen 110 to prevent backflow of secondary electrons 118 and avoid formation of ions 120 that may be accelerated towards the photocathode 106.

Figure 3B:
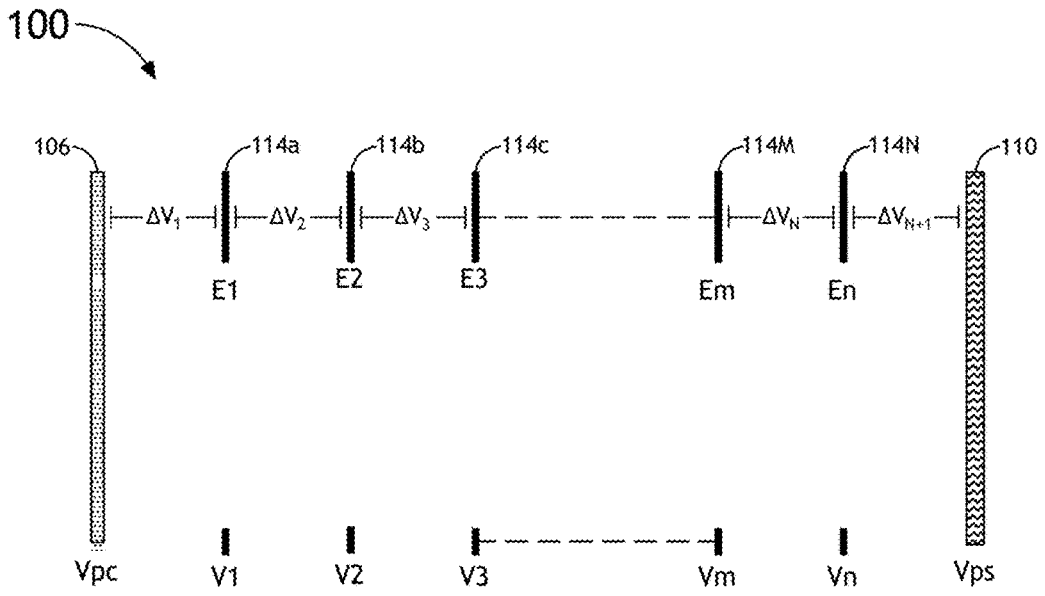
FIG. 3B illustrates electric potential differences between the photocathode, one or more electrodes, and a scintillating screen of the image intensifier tube, in accordance with an embodiment of this disclosure.

As shown in FIG. 3B, the negative potential barrier may be established and controlled by applying an electric potential Vps to the scintillating screen 110 that is greater than an electric potential Vn of at least one electrode 114N disposed proximate to the scintillating screen 110. To generate a stronger repulsive field 122 around the scintillating screen 110, the electrodes 114 may be configured to establish a first potential difference ΔVN+1 between the scintillating screen 110 and a first terminal electrode 114N greater than a second potential difference ΔVN between the first electrode terminal electrode 114N and a second terminal electrode 114M, where ΔVN+1=Vps−Vn and ΔVN=Vn−Vm. Electric potential differences between additional electrodes may be adjusted as well to establish a specified barrier profile for secondary electron repulsion and/or ion damage reduction, as discussed above with regards to aberration correction.

Figure 3C:
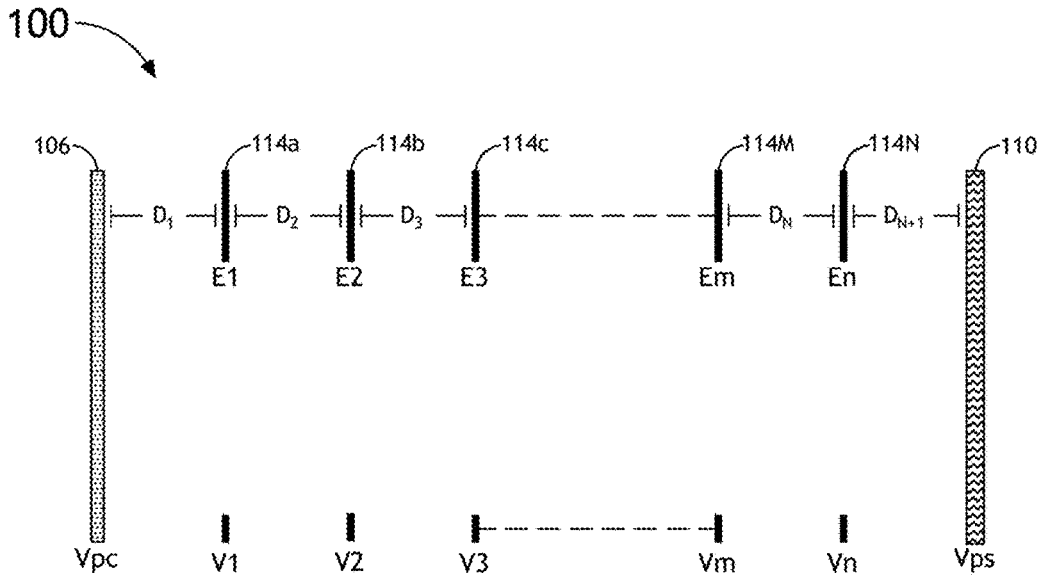
FIG. 3C illustrates spatial differences between the photocathode, one or more electrodes, and the scintillating screen of the image intensifier tube, in accordance with an embodiment of this disclosure.

Further, the negative potential barrier may be controlled according to spatial differences D between the scintillating screen 110 and one or more of the electrodes 114. As shown in FIG. 3C, the electrodes 114 may be distributed along the vacuum tube 102 according to a specified barrier profile. To generate a more repulsive electric field around the scintillating screen 110, a first spatial difference DN+1 between the scintillating screen 110 and the first terminal electrode 114N may be greater than a second spatial difference DN between the first terminal electrode 114N and the second electrode 114N+1. As with manipulation of the electric potential differences ΔV, the spatial differences D between several electrodes 114 may be varied to achieve the specified barrier profile. In some embodiments, spacing and electric potential differences between the scintillating screen 110 and one or more of the electrodes 114 are both established according to a specified barrier or electron repulsion profile.

The image intensifier tube 100 may be further configured for field curvature aberration correction and ion damage reduction in accordance with the foregoing embodiments. For example, the electrodes 114 may be configured to establish a specified acceleration profile around the photocathode 106 and a specified barrier (i.e. electron repulsion) profile around the scintillating screen 110. Accordingly, the image intensifier tube 100 may exhibit an enhanced operational life and improved resolution quality and uniformity across the entire field of view imaged by the image intensifier tube 100.

Figure 4:
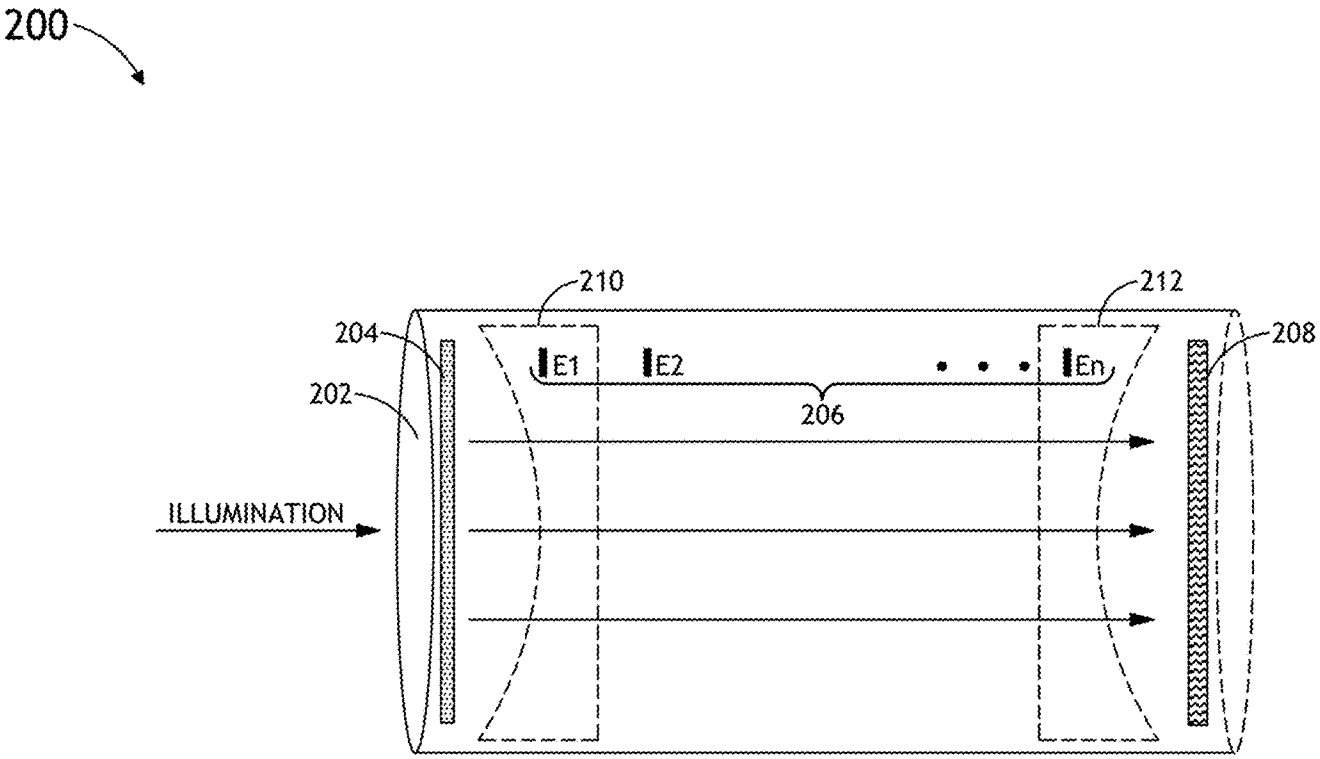
FIG. 4 illustrates an electron-bombarded detector configured for field curvature aberration correction and/or ion damage reduction, in accordance with an embodiment of this disclosure.

The aberration correction and ion damage reduction techniques or configurations that are described herein may be extended to functionally similar systems or devices. For example, FIG. 4 illustrates an electron-bombardment detector (EB-detector) 200, such as an EB-CCD or an EB-CMOS detector. EB-detectors 200 are often characterized as being hybrid devices inclusive of image intensifier tube and standard detector properties. Illumination received through an illumination window 202 of the EB-detector 200 impinges upon a photocathode 204 resulting in electron emissions. A plurality of electrodes 206 define an acceleration path within the EB-detector 200 to accelerate the emitted electrons towards an electron sensor 208, such as a back-thinned CCD or backside illumination (BSI) CMOS chip. The electron sensor 208 may be configured to generate an electrical signal in response to being impinged upon by the accelerated electrons.

Due to the structural similarity, the EB-detector 200 may suffer from similar field curvature aberration and/or ion damage problems present in state of the art image intensifier tubes. As described above with regard to image intensifier tube 100, the electric potential and/or spatial distribution of one or more electrodes 206 relative to the photocathode 204 may be manipulated to generate non-uniform accelerating electric fields 210 around the photocathode 204. Thus, the EB-detector 200 may be aberration corrected by accelerating off-axis electrons at a higher rate than on-axis electrons along at least a portion of the acceleration path. As described above with regards to the scintillating screen 110, the electric potential and/or spatial distribution of one or more electrodes 206 relative to the electron sensor 208 may be manipulated to generate a repulsive field 212 around the electron sensor 208. Secondary electrons that are emitted or deflected by the electron sensor 208 are thereby prevented from travelling backwards through the EB-detector 200 and forming ions that may damage the photocathode 204.

EB-detectors typically need to operate at relatively low incident energy to avoid generating X-rays within a CCD or CMOS chip. As such, the number of electrodes 206 within an EB-detector 200 is typically lower than the number of electrodes 114 within an image intensifier tube 100. The concepts described above with regard to the image intensifier tube 100 may, nevertheless, be applicable to EB-detectors 200 due to the structural similarities. It is further contemplated that the foregoing concepts may be extended to any illumination intensifier or detector architecture where electrons emitted by a photocathode are accelerated towards a scintillating screen or an electron sensor, regardless of any intermediate elements which may be included.

Figure 5A:
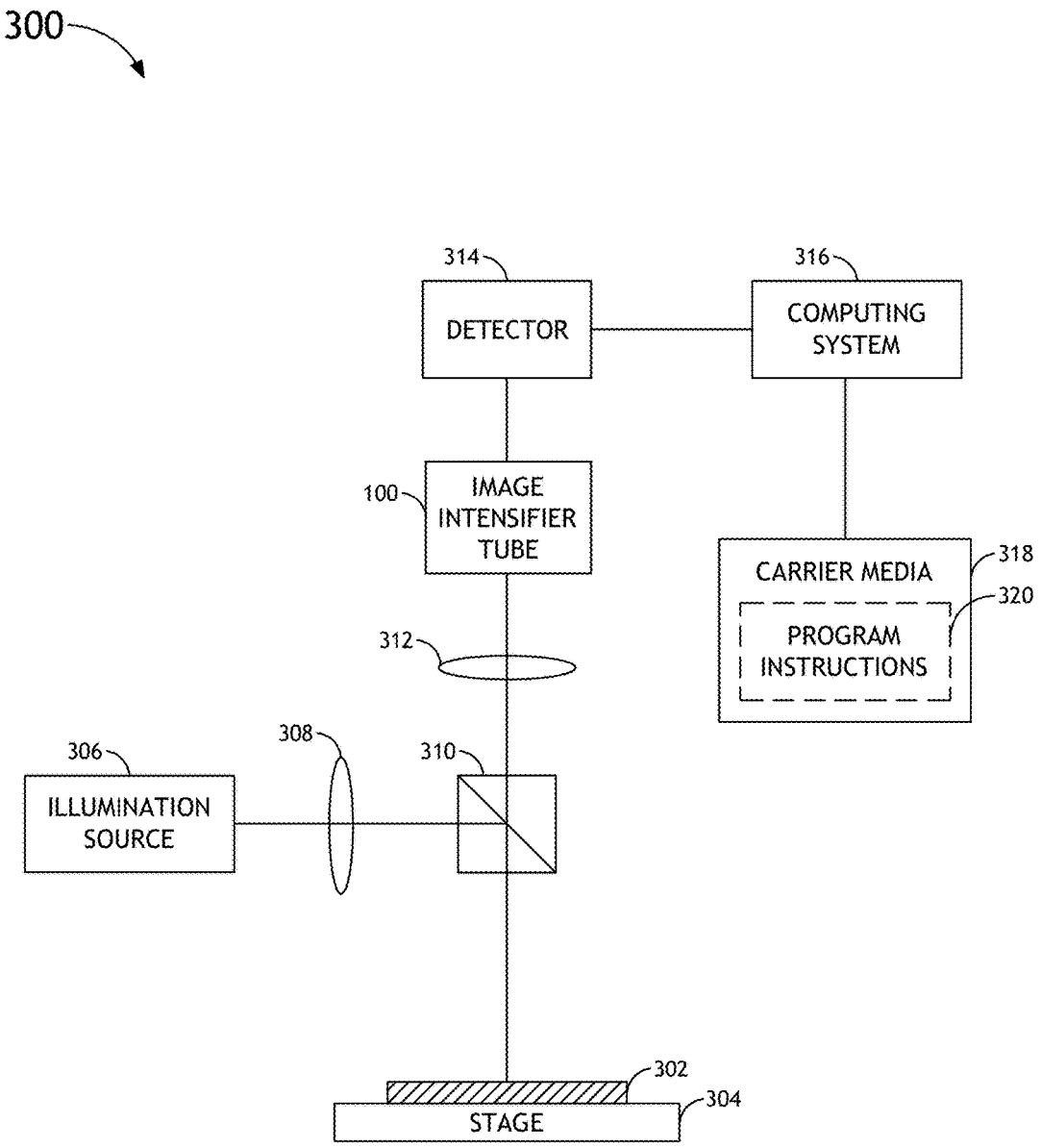
FIG. 5A is a block diagram illustrating a brightfield system for analyzing at least one sample, where the system includes the image intensifier tube, in accordance with an embodiment of this disclosure.
Figure 5B:
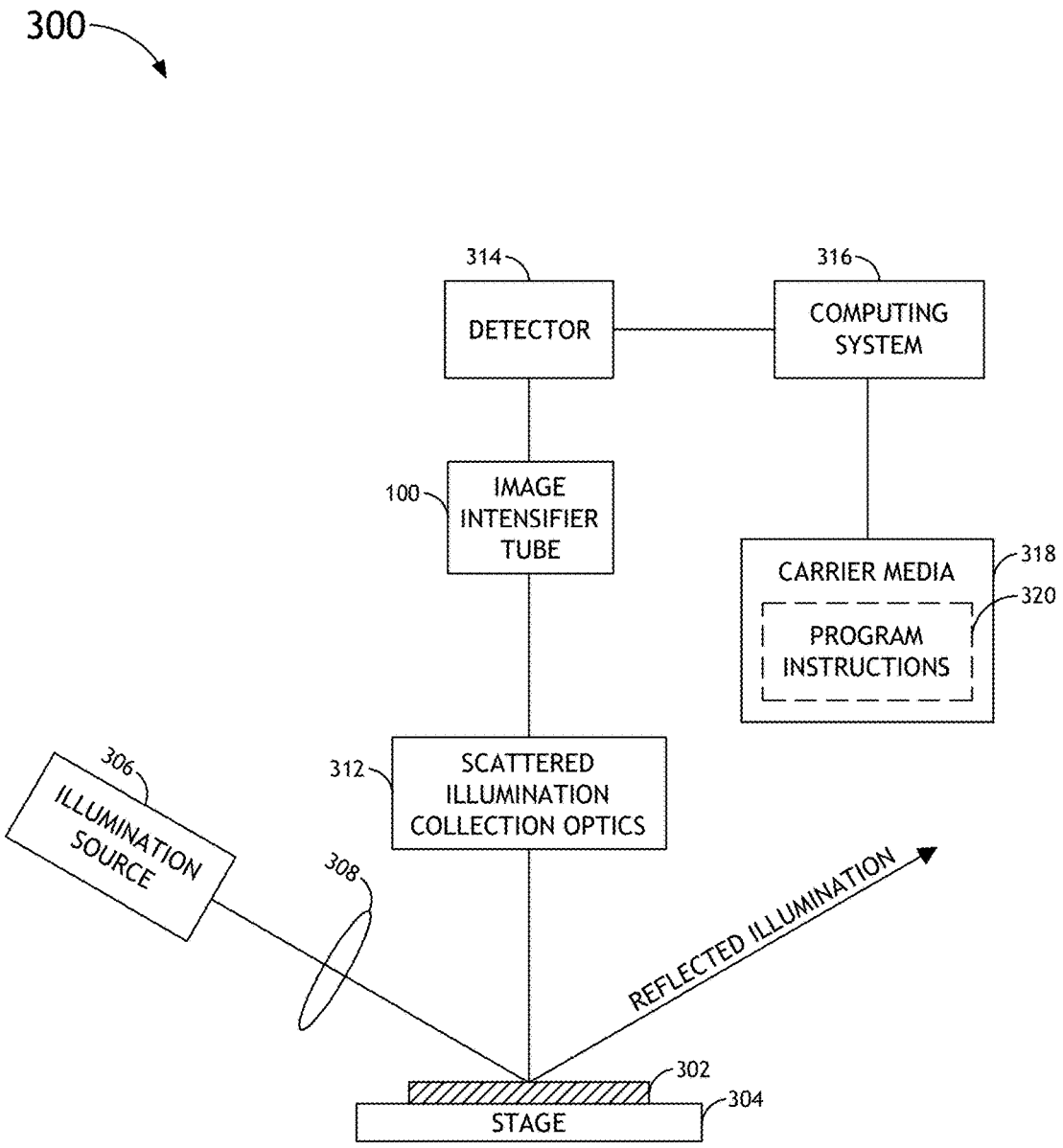
FIG. 5B is a block diagram illustrating a darkfield system for analyzing at least one sample, where the system includes the image intensifier tube, in accordance with an embodiment of this disclosure.
Figure 5C:
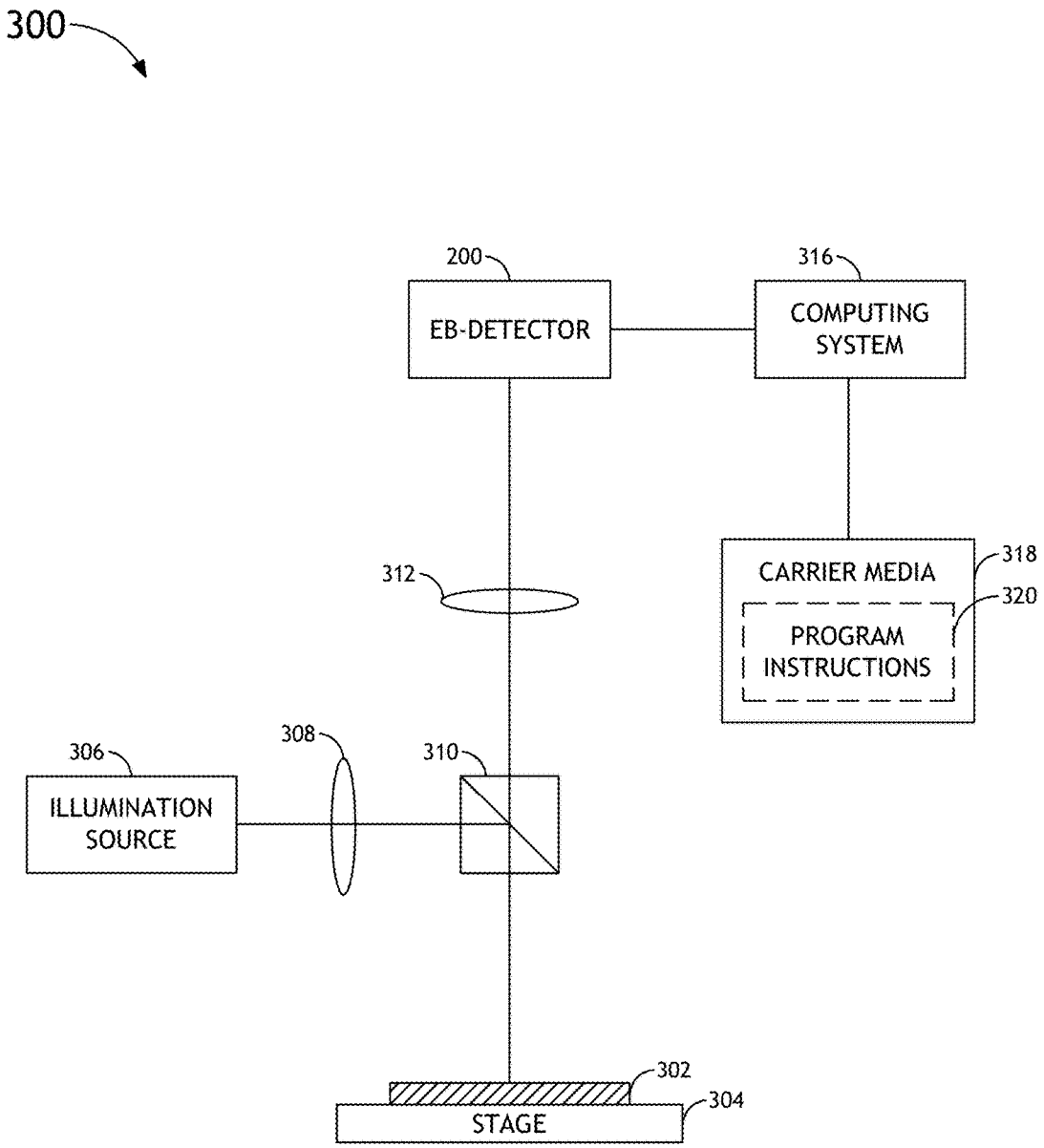
FIG. 5C is a block diagram illustrating a brightfield system for analyzing at least one sample, where the system includes the electron-bombarded detector, in accordance with an embodiment of this disclosure.
Figure 5D:
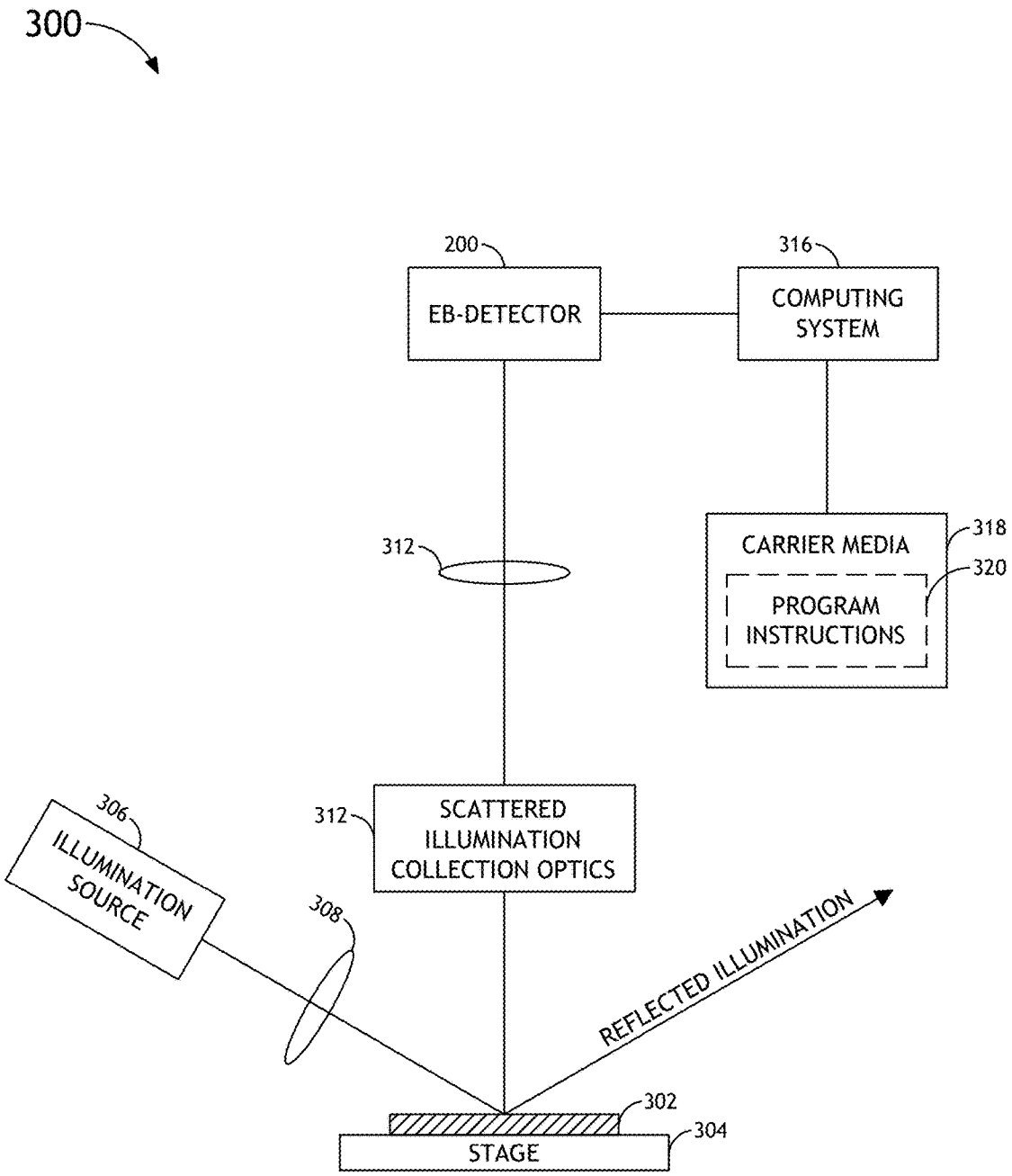
FIG. 5D is a block diagram illustrating a darkfield system for analyzing at least one sample, where the system includes the electron-bombarded detector, in accordance with an embodiment of this disclosure.

FIGS. 5A through 5D illustrate embodiments of a system 300 for analyzing at least one sample 302. FIGS. 5A and 5B illustrate embodiments where the system 300 includes the image intensifier tube 100 disposed along a collection path of the system 300. FIGS. 5C and 5D illustrate embodiments where the system 300 includes the EB-detector 200 instead of an image intensifier tube and detector combination. The system 300 may include any system utilizing an image intensifier or EB-detector to detect illumination reflected, scattered, and/or radiated from the surface of a sample 302 (e.g. semiconductor wafer, mask, tissue sample, or any artifact). For example, the system 300 may include an inspection system, an optical metrology system, or the like. It is further noted that FIGS. 5A through 5D illustrate generalized configurations of a brightfield system (FIGS. 5A and 5C) and a darkfield system (FIGS. 5B and 5D). Modifications to the components and/or arrangement of components to arrive at new configurations or system capabilities may be made without departing from the scope of this disclosure.

The system 300 may include a stage 304 configured to support the sample 302. In some embodiments, the stage 304 is further configured to actuate the sample 302 to a selected position or orientation. For example, the stage 304 may include or may be mechanically coupled to at least one actuator, such as a motor or servo, configured to translate or rotate the sample 302 for positioning, focusing, and/or scanning in accordance with a selected inspection or metrology algorithm, several of which are known to the art.

The system 300 may further include at least one illumination source 306 configured to provide illumination along an illumination path delineated by one or more illumination optics 308 to a surface of the sample 302. In some embodiments, the illumination path further includes a beam splitter 310 configured to direct at least a portion of the illumination to the surface of the sample 302 and illumination reflected, scattered, or radiated from the surface of the sample 302 along a collection path delineated by one or more collection optics 312 to an image intensifier tube 100. The image intensifier tube 100 may be designed according to one or more of the embodiments described above. In some embodiments, the collection optics 312 may include scattered illumination collection optics, as shown with regards to the darkfield system 300 illustrated in FIGS. 5B and 5D.

At least one detector 314, such as a camera (e.g. CCD camera) or any other photodetector, may be configured to receive output illumination emitted from the scintillating screen 110 as a result of illumination received at the photocathode 106 of the image intensifier tube 100 from the sample 302. As used herein, the terms illumination optics and collection optics include any combination of optical elements such as, but not limited to, focusing lenses, diffractive elements, polarizing elements, optical fibers, and the like.

The inspection system 300 may further include at least one computing system 316 communicatively coupled to the detector 314. The computing system 316 may include, but is not limited to, a personal computing system, mainframe computing system, workstation, image computer, parallel processor, or any processing device known in the art. In general, the term "computing system" may be broadly defined to encompass any device having one or more processors configured to execute program instructions 320 from at least one carrier medium 318. The computing system 316 may be configured to receive information (e.g. image frames, pixels, intensity measurements) associated with illumination collected by the detector 314. The computing system 316 may be further configured to carry out various inspection, imaging, metrology, and/or any other sample analysis algorithms known to the art utilizing the collected information.

FIGS. 5C and 5D illustrate alternative embodiments where the image intensifier tube 100 and the detector 314 are replaced by an EB-detector 200 designed according to one or more of the embodiments described above. The EB-detector 200 may be configured to receive illumination reflected, scattered, or radiated from the surface of the sample 302 along the collection path. Accordingly, in some embodiments, the computing system 316 is communicatively coupled to the EB-detector 200 and configured to receive information associated with the illumination collected by the EB-detector 200.

According to a selected algorithm, the computing system 316 may be configured to determine at least one spatial or physical attribute of the sample 302 based upon the detected illumination. For example, the computing system 316 may be configured to locate one or more defects of the sample 302 determine spatial measurements, such as defect size, layer thickness, feature size, trench spacing, overlay misalignment, and the like.

In some embodiments, the computing system 316 may be further configured to execute or control execution of various steps or functions described herein. For example, the computing system 316 may be configured to control: the image intensifier tube 100 (e.g. voltages applied to various terminals), the illumination source 306, and/or the one or more stage actuators.

Those having skill in the art will further appreciate that there are various vehicles by which processes and/or systems and/or other technologies described herein can be effected (e.g., hardware, software, and/or firmware), and that the preferred vehicle will vary with the context in which the processes and/or systems and/or other technologies are deployed. Program instructions implementing methods such as those described herein may be transmitted over or stored on carrier media. A carrier medium may include a transmission medium such as a wire, cable, or wireless transmission link. The carrier medium may also include a storage medium such as a read-only memory, a random access memory, a magnetic or optical disk, or a magnetic tape.

All of the methods described herein may include storing results of one or more steps of the method embodiments in a storage medium. The results may include any of the results described herein and may be stored in any manner known in the art. The storage medium may include any storage medium described herein or any other suitable storage medium known in the art. After the results have been stored, the results can be accessed in the storage medium and used by any of the method or system embodiments described herein, formatted for display to a user, used by another software module, method, or system, etc. Furthermore, the results may be stored "permanently," "semi-permanently," temporarily, or for some period of time. For example, the storage medium may be random access memory (RAM), and the results may not necessarily persist indefinitely in the storage medium.

Although particular embodiments of this invention have been illustrated, it is apparent that various modifications and embodiments of the invention may be made by those skilled in the art without departing from the scope and spirit of the foregoing disclosure. Accordingly, the scope of the invention should be limited only by the claims appended hereto.

What is claimed is:

1. An image intensifier tube, comprising:

a photocathode configured to emit electrons in response to incident illumination;

a scintillating screen configured to emit illumination in response to incident electrons including at least a portion of the emitted electrons received from the photocathode via an acceleration path; and a plurality of electrodes disposed along the acceleration path, the plurality of electrodes being configured to accelerate the emitted electrons along the acceleration path, the plurality of electrodes being further configured to generate at least a first accelerating electric field along a first portion of the acceleration path being traversed by at least one off-axis portion of the emitted electrons and a second accelerating electric field along a second portion of the acceleration path being traversed by at least one on-axis portion of the emitted electrons, the plurality of electrodes being further configured to generate a repulsive electric field relative to the scintillating screen preventing at least a portion of back-flowing electrons emitted or deflected by the scintillating screen from travelling towards the photocathode, the repulsive electric field configured to diverge the back-flowing electrons so to defocus ions generated by the back-flowing electrons.

2. The image intensifier tube of claim 1, wherein the plurality of electrodes includes at least a first electrode disposed proximate to the photocathode and a second electrode disposed proximate to the first electrode, wherein a first electric potential difference between the photocathode and the first electrode is greater than a second electric potential difference between the first electrode and the second electrode.

3. The image intensifier tube of claim 2, wherein the second electric potential difference between the first electrode and the second electrode is greater than at least a third electric potential difference between the second electrode and a third electrode of the plurality of electrodes.

4. The image intensifier tube of claim 2, wherein the plurality of electrodes are spaced substantially uniformly along the acceleration path.

5. The image intensifier tube of claim 1, wherein the plurality of electrodes includes at least a first electrode disposed proximate to the photocathode and a second electrode disposed proximate to the first electrode, wherein a first spatial difference between the photocathode and the first electrode is lesser than a second spatial difference between the first electrode and the second electrode.

6. The image intensifier tube of claim 5, wherein the second spatial difference between the first electrode and the second electrode is lesser than at least a third spatial difference between the second electrode and a third electrode of the plurality of electrodes.

7. The image intensifier tube of claim 5, wherein a first electric potential difference between the photocathode and the first electrode is greater than a second electric potential difference between the first electrode and the second electrode.

8. The image intensifier tube of claim 1, wherein an electric potential of one or more electrodes of the plurality of electrodes is less than an electric potential of the scintillating screen, the one or more electrodes being disposed proximate to the scintillating screen.

9. The image intensifier tube of claim 1, wherein the plurality of electrodes includes at least a first electrode disposed proximate to the scintillating screen and a second electrode disposed proximate to the first electrode, wherein a first electric potential difference between the scintillating screen and the first electrode is greater than a second electric potential difference between the first electrode and the second electrode.

10. The image intensifier tube of claim 1, wherein the plurality of electrodes includes at least a first electrode disposed proximate to the scintillating screen and a second electrode disposed proximate to the first electrode, wherein a first spatial difference between the scintillating screen and the first electrode is greater than a second spatial difference between the first electrode and the second electrode.

11. An image intensifier tube, comprising:

a photocathode configured to emit electrons in response to incident illumination;

a scintillating screen configured to emit illumination in response to incident electrons including at least a portion of the emitted electrons received from the photocathode via an acceleration path; and a plurality of electrodes disposed along the acceleration path, the plurality of electrodes being configured to accelerate the emitted electrons along the acceleration path, the plurality of electrodes being further configured to generate a repulsive electric field relative to the scintillating screen preventing at least a portion of back-flowing electrons emitted or deflected by the scintillating screen from travelling towards the photocathode, the repulsive electric field configured to diverge the back-flowing electrons so to defocus ions generated by the back-flowing electrons.

12. The image intensifier tube of claim 11, wherein an electric potential of one or more electrodes of the plurality of electrodes is less than an electric potential of the scintillating screen, the one or more electrodes being disposed proximate to the scintillating screen.

13. The image intensifier tube of claim 11, wherein the plurality of electrodes includes at least a first electrode disposed proximate to the scintillating screen and a second electrode disposed proximate to the first electrode, wherein a first electric potential difference between the scintillating screen and the first electrode is greater than a second electric potential difference between the first electrode and the second electrode.

14. The image intensifier tube of claim 11, wherein the plurality of electrodes includes at least a first electrode disposed proximate to the scintillating screen and a second electrode disposed proximate to the first electrode, wherein a first spatial difference between the scintillating screen and the first electrode is greater than a second spatial difference between the first electrode and the second electrode.

15. The image intensifier tube of claim 11, wherein the plurality of electrodes are further configured to generate at least a first accelerating electric field along a first portion of the acceleration path being traversed by at least one off-axis portion of the emitted electrons and a second accelerating electric field along a second portion of the acceleration path being traversed by at least one on-axis portion of the emitted electrons, the first accelerating electric field being stronger than the second accelerating electric field.

16. The image intensifier tube of claim 15, wherein the plurality of electrodes includes at least a first electrode disposed proximate to the photocathode and a second electrode disposed proximate to the first electrode, wherein a first electric potential difference between the photocathode and the first electrode is greater than a second electric potential difference between the first electrode and the second electrode.

17. The image intensifier tube of claim 15, wherein the plurality of electrodes includes at least a first electrode disposed proximate to the photocathode and a second electrode disposed proximate to the first electrode, wherein a first spatial difference between the photocathode and the first electrode is lesser than a second spatial difference between the first electrode and the second electrode.

18. The image intensifier tube of claim 17, wherein a first electric potential difference between the photocathode and the first electrode is greater than a second electric potential difference between the first electrode and the second electrode.

19. A system for analyzing a sample, comprising:

at least one illumination source configured to illuminate a sample;

an image intensifier tube configured to receive at least a portion of illumination scattered, reflected, or radiated from the sample, the image intensifier tube including: a photocathode configured to emit electrons in response to the illumination received from the sample, a scintillating screen configured to emit illumination in response to incident electrons including at least a portion of the emitted electrons received from the photocathode via an acceleration path, and a plurality of electrodes disposed along the acceleration path, the plurality of electrodes being configured to accelerate the emitted electrons along the acceleration path, the plurality of electrodes being further configured to generate at least a first accelerating electric field along a first portion of the acceleration path being traversed by at least one off-axis portion of the emitted electrons and a second accelerating electric field along a second portion of the acceleration path being traversed by at least one on-axis portion of the emitted electrons, the plurality of electrodes being further configured to generate a repulsive electric field relative to the scintillating screen preventing at least a portion of back-flowing electrons emitted or deflected by the scintillating screen from travelling towards the photocathode, the repulsive electric field configured to diverge the back-flowing electrons so to defocus ions generated by the back-flowing electrons;

at least one detector configured to receive at least a portion of the illumination emitted by the scintillating screen of the image intensifier tube; and at least one computing system in communication with the at least one detector, the at least one computing system being configured to determine at least one spatial or physical attribute of the sample based upon the detected illumination.

20. A system for analyzing a sample, comprising:

at least one illumination source configured to illuminate a sample;

an image intensifier tube configured to receive at least a portion of illumination scattered, reflected, or radiated from the sample, the image intensifier tube including: a photocathode configured to emit electrons in response to the illumination received from the sample, a scintillating screen configured to emit illumination in response to incident electrons including at least a portion of the emitted electrons received from the photocathode via an acceleration path, and a plurality of electrodes disposed along the acceleration path, the plurality of electrodes being configured to accelerate the emitted electrons along the acceleration path, the plurality of electrodes being further configured to generate a repulsive electric field relative to the scintillating screen preventing at least a portion of back-flowing electrons emitted or deflected by the scintillating screen from travelling towards the photocathode, the repulsive electric field configured to diverge the back-flowing electrons so to defocus ions generated by the back-flowing electrons;

at least one detector configured to receive at least a portion of the illumination emitted by the scintillating screen of the image intensifier tube; and at least one computing system in communication with the at least one detector, the at least one computing system being configured to determine at least one spatial or physical attribute of the sample based upon the detected illumination.

21. A detector, comprising:

a photocathode configured to emit electrons in response to incident illumination;

an electron sensor configured to generate an electrical signal in response to incident electrons including at least a portion of the emitted electrons received from the photocathode via an acceleration path; and a plurality of electrodes disposed along the acceleration path, the plurality of electrodes being configured to accelerate the emitted electrons along the acceleration path, the plurality of electrodes being further configured to generate at least a first accelerating electric field along a first portion of the acceleration path being traversed by at least one off-axis portion of the emitted electrons and a second accelerating electric field along a second portion of the acceleration path being traversed by at least one on-axis portion of the emitted electrons, the plurality of electrodes being further configured to generate a repulsive electric field relative to the electron sensor preventing at least a portion of back-flowing electrons emitted or deflected by the electron sensor from travelling towards the photocathode, the repulsive electric field configured to diverge the back-flowing electrons so to defocus ions generated by the back-flowing electrons.

22. The detector of claim 21, wherein the plurality of electrodes includes at least a first electrode disposed proximate to the photocathode and a second electrode disposed proximate to the first electrode, wherein a first electric potential difference between the photocathode and the first electrode is greater than a second electric potential difference between the first electrode and the second electrode.

23. The detector of claim 22, wherein the second electric potential difference between the first electrode and the second electrode is greater than at least a third electric potential difference between the second electrode and a third electrode of the plurality of electrodes.

24. The detector of claim 22, wherein the plurality of electrodes are spaced substantially uniformly along the acceleration path.

25. The detector of claim 21, wherein the plurality of electrodes includes at least a first electrode disposed proximate to the photocathode and a second electrode disposed proximate to the first electrode, wherein a first spatial difference between the photocathode and the first electrode is lesser than a second spatial difference between the first electrode and the second electrode.

26. The detector of claim 25, wherein the second spatial difference between the first electrode and the second electrode is lesser than at least a third spatial difference between the second electrode and a third electrode of the plurality of electrodes.

27. The detector of claim 25, wherein a first electric potential difference between the photocathode and the first electrode is greater than a second electric potential difference between the first electrode and the second electrode.

28. The detector of claim 21, wherein an electric potential of one or more electrodes of the plurality of electrodes is less than an electric potential of the electron sensor, the one or more electrodes being disposed proximate to the electron sensor.

29. The detector of claim 21, wherein the plurality of electrodes includes at least a first electrode disposed proximate to the electron sensor and a second electrode disposed proximate to the first electrode, wherein a first electric potential difference between the electron sensor and the first electrode is greater than a second electric potential difference between the first electrode and the second electrode.

30. The detector of claim 21, wherein the plurality of electrodes includes at least a first electrode disposed proximate to the electron sensor and a second electrode disposed proximate to the first electrode, wherein a first spatial difference between the electron sensor and the first electrode is greater than a second spatial difference between the first electrode and the second electrode.

31. A detector, comprising:

a photocathode configured to emit electrons in response to incident illumination;

an electron sensor configured to generate an electrical signal in response to incident electrons including at least a portion of the emitted electrons received from the photocathode via an acceleration path; and a plurality of electrodes disposed along the acceleration path, the plurality of electrodes being configured to accelerate the emitted electrons along the acceleration path, the plurality of electrodes being further configured to generate a repulsive electric field relative to the electron sensor preventing at least a portion of back-flowing electrons emitted or deflected by the electron sensor from travelling towards the photocathode, the repulsive electric field configured to diverge the back-flowing electrons so to defocus ions generated by the back-flowing electrons.

32. The detector of claim 31, wherein an electric potential of one or more electrodes of the plurality of electrodes is less than an electric potential of the electron sensor, the one or more electrodes being disposed proximate to the electron sensor.

33. The detector of claim 31, wherein the plurality of electrodes includes at least a first electrode disposed proximate to the electron sensor and a second electrode disposed proximate to the first electrode, wherein a first electric potential difference between the electron sensor and the first electrode is greater than a second electric potential difference between the first electrode and the second electrode.

34. The detector of claim 31, wherein the plurality of electrodes includes at least a first electrode disposed proximate to the electron sensor and a second electrode disposed proximate to the first electrode, wherein a first spatial difference between the electron sensor and the first electrode is greater than a second spatial difference between the first electrode and the second electrode.

35. The detector of claim 31, wherein the plurality of electrodes are further configured to generate at least a first accelerating electric field along a first portion of the acceleration path being traversed by at least one off-axis portion of the emitted electrons and a second accelerating electric field along a second portion of the acceleration path being traversed by at least one on-axis portion of the emitted electrons, the first accelerating electric field being stronger than the second accelerating electric field.

36. The detector of claim 35, wherein the plurality of electrodes includes at least a first electrode disposed proximate to the photocathode and a second electrode disposed proximate to the first electrode, wherein a first electric potential difference between the photocathode and the first electrode is greater than a second electric potential difference between the first electrode and the second electrode.

37. The detector of claim 35, wherein the plurality of electrodes includes at least a first electrode disposed proximate to the photocathode and a second electrode disposed proximate to the first electrode, wherein a first spatial difference between the photocathode and the first electrode is lesser than a second spatial difference between the first electrode and the second electrode.

38. The detector of claim 35, wherein a first electric potential difference between the photocathode and the first electrode is greater than a second electric potential difference between the first electrode and the second electrode.

39. A system for analyzing a sample, comprising:

at least one illumination source configured to illuminate a sample;

at least one detector configured to receive at least a portion of illumination scattered, reflected, or radiated from the sample, the at least one detector including: a photocathode configured to emit electrons in response to incident illumination, an electron sensor configured to generate an electrical signal in response to incident electrons including at least a portion of the emitted electrons received from the photocathode via an acceleration path, and a plurality of electrodes disposed along the acceleration path, the plurality of electrodes being configured to accelerate the emitted electrons along the acceleration path, the plurality of electrodes being further configured to generate at least a first accelerating electric field along a first portion of the acceleration path being traversed by at least one off-axis portion of the emitted electrons and a second accelerating electric field along a second portion of the acceleration path being traversed by at least one on-axis portion of the emitted electrons, the plurality of electrodes being further configured to generate a repulsive electric field relative to the electron sensor preventing at least a portion of back-flowing electrons emitted or deflected by the electron sensor from travelling towards the photocathode, the repulsive electric field configured to diverge the back-flowing electrons so to defocus ions generated by the back-flowing electrons and at least one computing system in communication with the at least one detector, the at least one computing system being configured to determine at least one spatial or physical attribute of the sample based upon the detected illumination.

40. A system for analyzing a sample, comprising:

at least one illumination source configured to illuminate a sample;

at least one detector configured to receive at least a portion of illumination scattered, reflected, or radiated from the sample, the at least one detector including: a photocathode configured to emit electrons in response to incident illumination, an electron sensor configured to generate an electrical signal in response to incident electrons including at least a portion of the emitted electrons received from the photocathode via an acceleration path, and a plurality of electrodes disposed along the acceleration path, the plurality of electrodes being configured to accelerate the emitted electrons along the acceleration path, the plurality of electrodes being further configured to generate a repulsive electric field relative to the electron sensor preventing at least a portion of back-flowing electrons emitted or deflected by the electron sensor from travelling towards the photocathode, the repulsive electric field configured to diverge the back-flowing electrons so to defocus ions generated by the back-flowing electrons; and at least one computing system in communication with the at least one detector, the at least one computing system being configured to determine at least one spatial or physical attribute of the sample based upon the detected illumination.

* * * * *